US010244832B2

(12) United States Patent
Kakadiya

(10) Patent No.: US 10,244,832 B2
(45) Date of Patent: Apr. 2, 2019

(54) DOUBLE LOCK MECHANISM

(71) Applicant: Samir Kakadiya, Mumbai (IN)

(72) Inventor: Samir Kakadiya, Mumbai (IN)

(73) Assignee: Patdiam Jewellery Limited, Mumbai (IN)

( * ) Notice: Subject to any disclaimer, the term of this patent is extended or adjusted under 35 U.S.C. 154(b) by 103 days.

(21) Appl. No.: 15/294,410

(22) Filed: Oct. 14, 2016

(65) Prior Publication Data

US 2018/0103732 A1 Apr. 19, 2018

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 9/0046; A44C 7/00
See application file for complete search history.

(56) References Cited

U.S. PATENT DOCUMENTS 4,489,466 A * 12/1984 Bakker ..... A41F 3/02 24/489
4,694,664 A * 9/1987 Elsener ..... A44C 7/00 63/12
4,815,180 A * 3/1989 Elsener ..... A44C 5/2033 24/616
5,267,374 A * 12/1993 Drake ..... B65D 33/1675 24/30.5 R
5,816,073 A * 10/1998 Bardisbanyan ..... A44C 7/00 63/12
5,913,478 A * 6/1999 Ochsman ..... A41F 11/06 24/541
5,933,922 A * 8/1999 Ochsman ..... A45F 5/02 24/3.11
6,125,657 A * 10/2000 Esposito ..... A44C 7/00 24/598.2
6,843,072 B1 * 1/2005 Lau ..... A44C 7/00 24/629
7,107,789 B1 * 9/2006 Bruner ..... A44C 5/2042 63/15
7,770,413 B2 * 8/2010 Tyler ..... A44C 9/0038 24/303
9,066,562 B2 * 6/2015 Azar ..... A44C 5/12
2011/0056241 A1 * 3/2011 Li ..... A44C 7/00 63/12
2013/0276478 A1 * 10/2013 Huynh ..... A44C 5/00 63/12
2015/0052944 A1 * 2/2015 Affolter ..... A44C 9/0046 63/15.65

(Continued)

*Primary Examiner* — Jason W San
(74) *Attorney, Agent, or Firm* — Lombard & Geliebter LLP; Eric J. Huang

(57) ABSTRACT

A double lock mechanism is provided that comprises a post section comprising a locking post and a plurality of post slots recessed into the locking post; and a locking section configured to engage the post section. The locking section comprises an insertion cavity configured to receive the locking post, a plurality of locking bars each having locking tips, and a spring configured to bias the locking bars in an engaged orientation relative to the post slots such that the locking tips engage the post slots; and wherein the locking tips are configured to disengage the post section when an external force is applied to the locking bars.

7 Claims, 4 Drawing Sheets

(56) References Cited

U.S. PATENT DOCUMENTS

| | | | | |
|---|---|---|---|---|
| 2016/0037881 | A1* | 2/2016 | Thomas | A44C 7/008<br>24/705 |
| 2016/0270490 | A1* | 9/2016 | Huynh | A44C 5/12 |
| 2017/0071296 | A1* | 3/2017 | Shirasaka | A44C 5/0092 |
| 2017/0079387 | A1* | 3/2017 | Dobashi | A44C 7/003 |

* cited by examiner

DOUBLE LOCK MECHANISM

BACKGROUND OF THE INVENTION

The present invention relates to a locking mechanism for fastening and unfastening jewelry, such as hinged earrings.

Earrings, especially hinged hoop earrings, are used worldwide. The traditional mechanism for opening and closing earrings includes a post, which is passed through a pierced ear, and fastened by some type of catch. This mechanism is sometimes difficult to open successfully. Accordingly, there is a need for a locking mechanism that overcomes this challenge.

SUMMARY OF THE INVENTION

A double lock mechanism is provided that includes a post section and a locking section. The post section may include a locking post and a plurality of post slots recessed into the locking post.

The locking section may be configured to engage the post section. The locking section may include an insertion cavity, a plurality of locking bars, and a spring. The insertion cavity may be configured to receive the locking post.

Each of the plurality of locking bars may have an outwardly facing side and an inwardly facing side. Each of the outwardly facing sides may have a grip surface. Each of the inwardly facing sides may have a first end having a locking tip configured to engage one of the plurality of post slots, a second end having a spring tip, and an attachment point between the first end and second end at which each of the locking bars may be pivotally coupled to the locking section.

The spring may have two ends, where each end is attached to each of the spring tips, and where the spring is configured to spread the spring tips away from each other and bias the locking bars in an engaged orientation relative to the post slots, such that the locking tips engage the post slots.

The plurality of locking bars may be configured to disengage the post section when an external force is applied to the grip surfaces, causing each of the locking tips to disengage the one of the plurality of post slots.

In at least one embodiment, the post slots may be disposed on opposite sides of the locking post.

In at least one embodiment, the post slots may be offset from each other along an axis of the locking post.

In at least one embodiment, the distance from each of the locking tips to the attachment points on the respective locking bars may be of different lengths such that the locking tips are offset from each other.

In at least one embodiment, the attachment points at which each of the locking bars are pivotally coupled may constitute a single attachment point that share a common pivoting axis.

In at least one embodiment, the grip surfaces may have a rough finish. In at least one embodiment, the rough finish may be bumps, grooves, or a similarly textured surface.

In at least one embodiment, the double lock mechanism may include a jewelry body having a first end, a second end, and a hinge between the first end and second end, where the post section further has a first attachment end and the locking section further comprises a second attachment end; and where the first attachment end is attached to the first end of the jewelry body and the second attachment end is attached to the second end of the jewelry body.

In at least one embodiment, the lock section of the double lock mechanism may be partially disposed within the jewelry body such that only the grip surfaces, or a portion thereof, are exposed.

DETAILED DESCRIPTION OF THE INVENTION

The present application generally provides a novel double lock mechanism for fastening/unfastening jewelry, such as hinged earrings.

Figure 1:
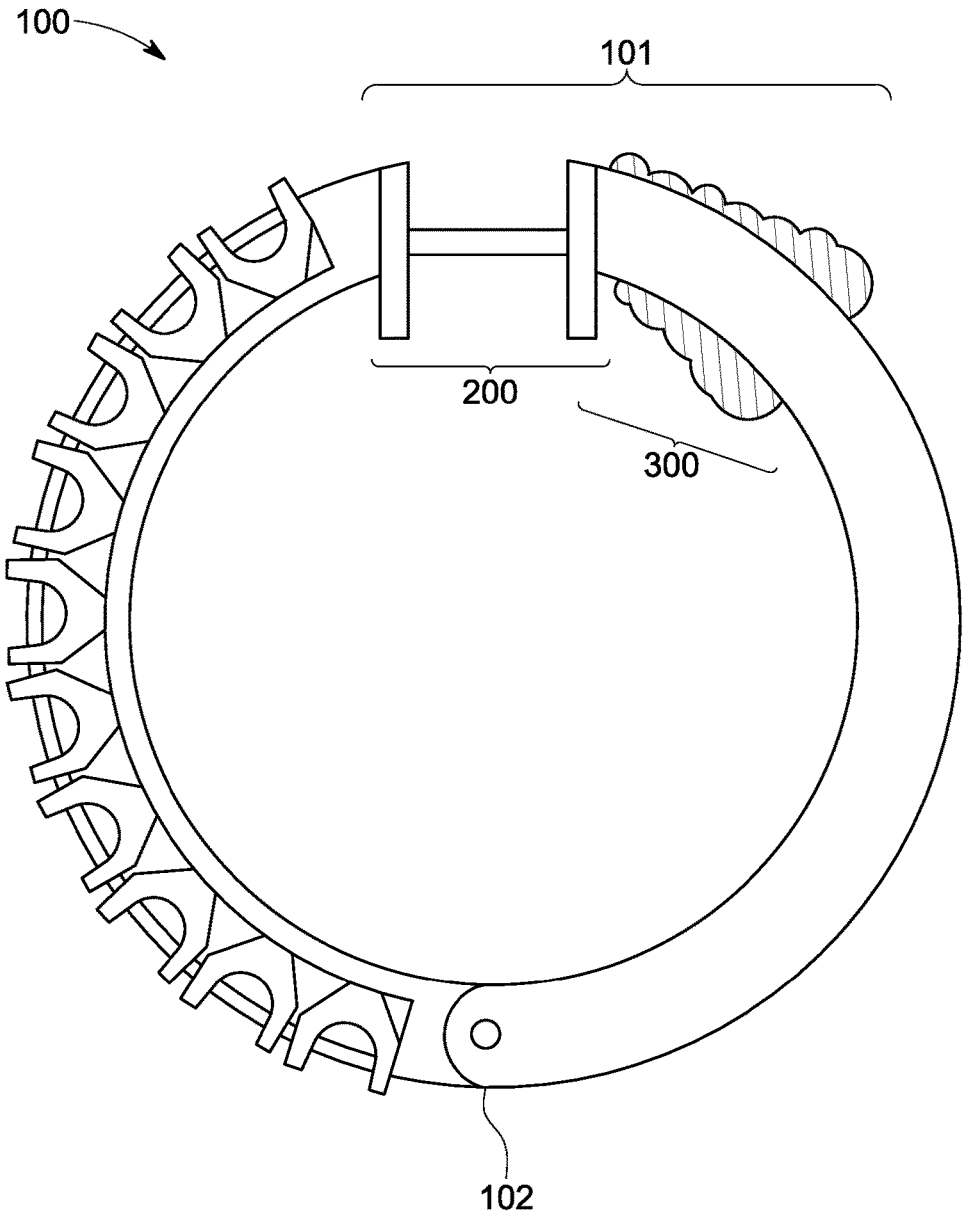
FIG. 1 is a schematic view of a hinged earring with a double lock mechanism according to one embodiment of the mechanism disclosed herein.
Figure 2A:
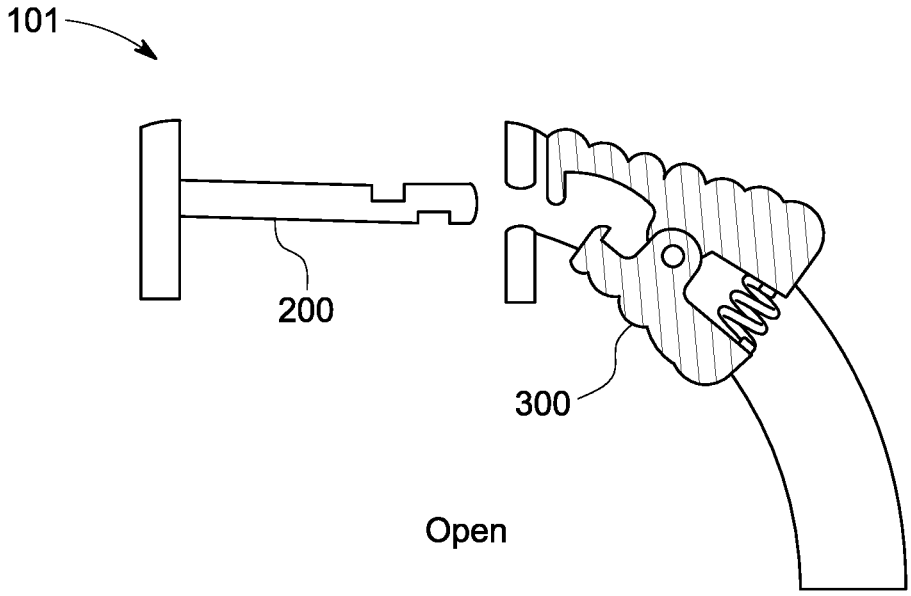
FIG. 2A is a partial cross-sectional view of the double lock mechanism according to at least one embodiment in its open form.
Figure 2B:
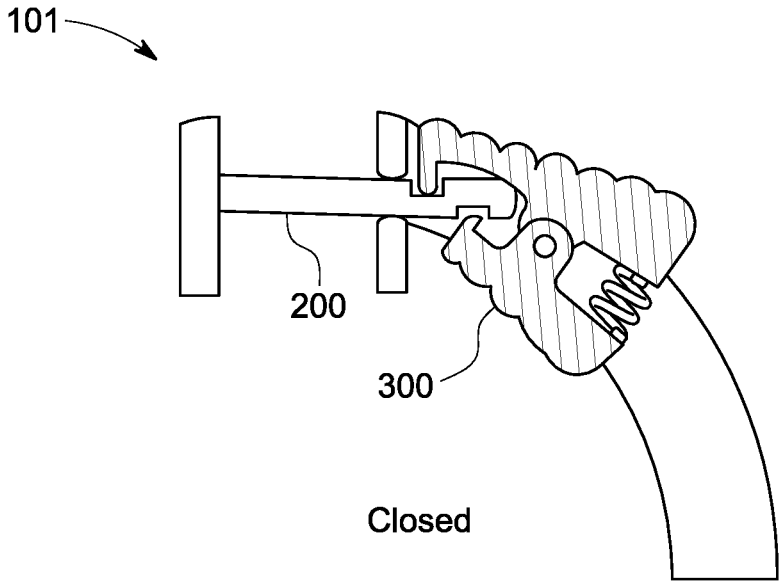
FIG. 2B is a partial cross-sectional view of the double lock mechanism according to at least one embodiment in its closed form.

Referring to FIG. 1, according to at least one embodiment, an earring 100 is shown having a double lock mechanism 101 and an earring hinge 102. The earring 100 includes a post section 200 that is hinged to a lock section 300. The post section 200 forms one end of the earring 100 and the lock section 300 forms the other end of the earring 100, and are capable of selectively interlocking at the ends opposite the earring hinge 102. That is, the earring 100 is capable of being positioned in at least one open or unlocked state, as shown in FIG. 2A, and a closed or locked state, as shown in FIG. 2B. Although the hinged and lock sections appear to be about half of the circumference of the hoop, it is understood that the size of each sections may differ according to the needs of the designer.

Referring to FIGS. 2A and 2B, the post section 200 includes a locking post 201 having first and second post slots 202 and 203 recessed into the locking post 201. The slots 202 and 203 are preferably disposed on opposite sides of the post, as shown. That is, the slots 203, 203 form grooves in the post 201 that are essentially parallel to each other, located, for example, on the top and bottom of the post 201. In a preferred embodiment, the post slots 202, 203 are offset from each other along the axis of the locking post. For example, slot 202 may be located closer on the post 201 to the hinge than slot 203.

The lock section 300 has an insertion cavity 301 that receives the post 201 and a locking mechanism that engages the post slots 202, 203. In one embodiment, the lock section 300 includes two locking bars 310 and 320, and a spring 330 that biases the locking bars 310 and 320 in the engaged orientation relative to the post slots 202, 203.

Figure 3A:
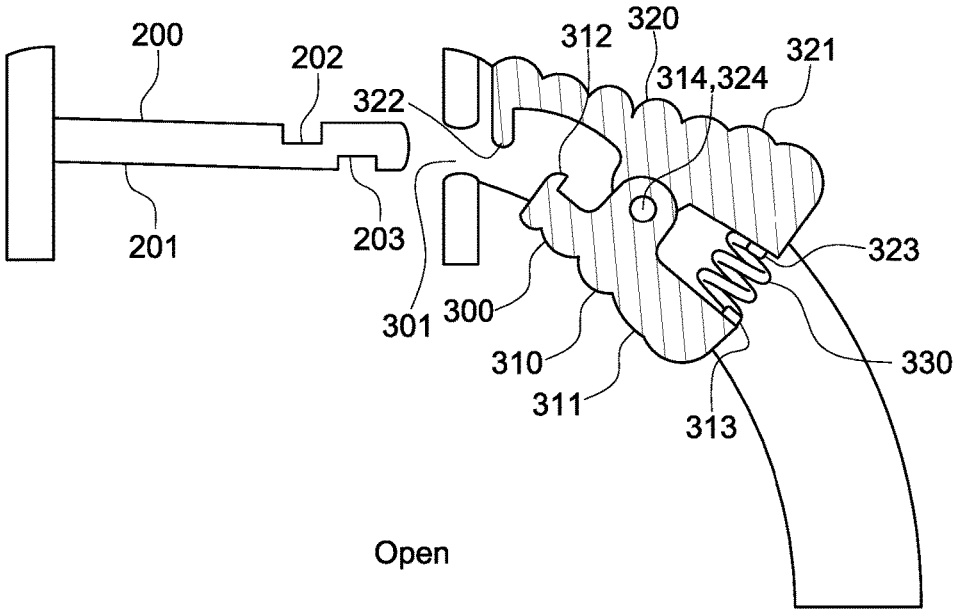
FIG. 3A is a detailed partial cross-sectional view of the double lock mechanism according to at least one embodiment in its open form.
Figure 3B:
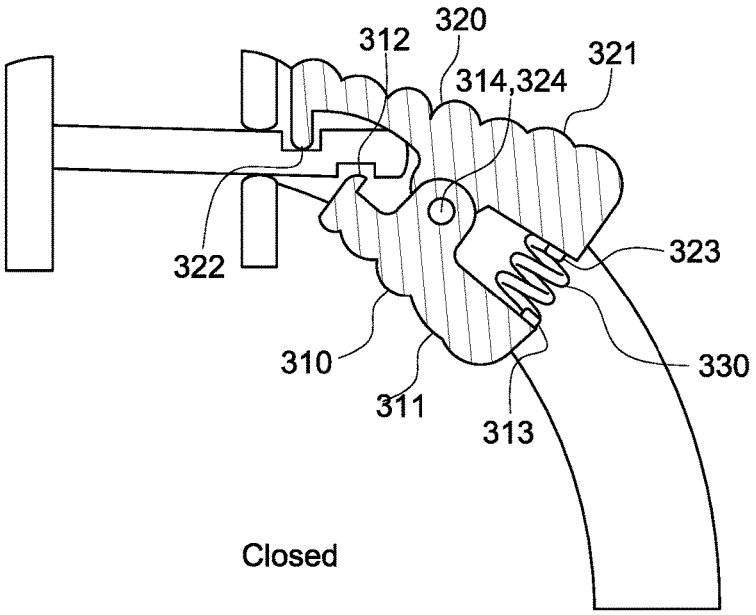
FIG. 3B is a detailed partial cross-sectional view of the double lock mechanism according to at least one embodiment in its closed form.
Figure 4:
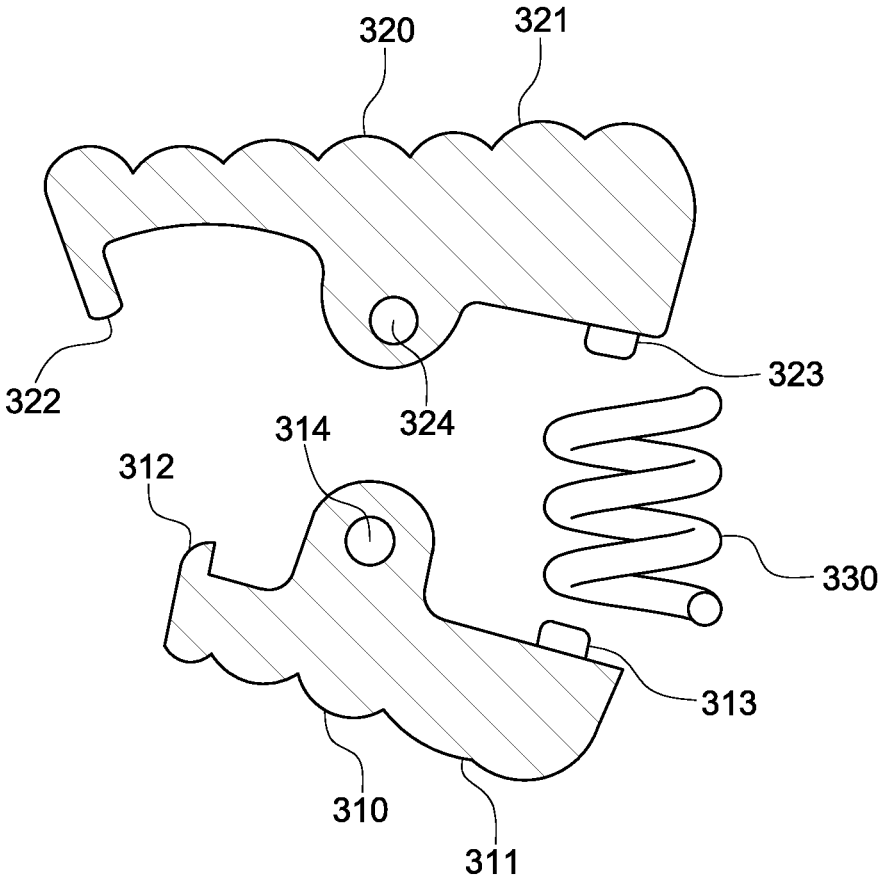
FIG. 4 is an exploded view of the double lock mechanism according to at least one embodiment.

Referring to FIGS. 3A and 3B and in exploded view in FIG. 4, the outwardly facing side of each locking bar 310 and 320 has a grip surface 311 and 321, respectively. The inwardly facing side of each locking bar 310 and 320 has a locking tip 312 and 322, respectively, that engage the slots 202, 203. The locking bars 310 and 320 may include spring tips 313 and 323, respectively, opposite the locking tips 312 and 322. In one embodiment, the locking bars 310 and 320 are pivotally coupled to each other at attachment point 314 and 324, respectively. The distance of each of the locking tips 312 and 322 from the attachment points 314 and 324, respectively, creates an axial offset to engage the offset slots 202, 203 as shown. A spring is preferably provided that spreads the spring tips 313 and 323 away from each other, and correspondingly biases the locking tips 312, 322 toward each other. The spring may be located between the spring tips 313 and 323, which provide attachment points for the spring.

In at least one embodiment, the locking bars 310 and 320 are pivotally attached to the earring body 100 at attachment points 314 and 324, respectively, which themselves constitute a single pivot point. In other words, the locking bars share a common pivoting axis. The locking tips 312 and 322 are capable of engaging and locking with the post slots 202 and 203, respectively, by means of the coil spring 330.

In a preferred embodiment, the distance of each of the locking tips 312 and 322 from the attachment points 314 and 324 are of different lengths such that the locking tips 312 and 322 are offset from each other, but may be in any position in relation to each other so long as they do not contact.

In a preferred embodiment, the grip surfaces 311 and 321 have a rough finish to facilitate gripping of the locking bars 310 and 320, respectively, by the user during operation. In a preferred embodiment, the rough finish could consist of bumps, grooves, or other such textured surfaces.

In a preferred embodiment, as seen best with reference to FIG. 1, the lock section 300 is partially disposed within the body of the earring 100 such that only the grip surfaces 311 and 321, or a portion thereof, of the locking bars 310 and 320, respectively, are exposed.

In operation, to engage the lock, a force is applied to the body of the earring 100 to cause the locking post 201 to be inserted into the insertion cavity 301. As the locking post is inserted, it glides between, and in contact with, locking tips 312 and 322 of the locking bars 310 and 320, respectively, until the locking tips contact post slots 202 and 203, respectively. At the same time, the spring 330 exerts a force against the locking bars 310 and 320 at spring tips 313 and 323, respectively, causing a rotational motion of the locking bars 310 and 320 around the attachment points 314 and 324, respectively, further causing a rotational movement of the locking tips 312 and 322 in the opposite direction, causing them to engage the post slots 202 and 203, such that they hold the locking post 201 in a fixed position relative to the locking section 300.

To release the lock, forces are applied to the grip surfaces 311 and 321 of locking bars 310 and 320, respectively, compressing the spring 330 at spring tips 313 and 323, respectively, causing a rotational motion of the locking bars 310 and 320 around the attachment points 314 and 324, respectively, further causing a rotational movement of the locking tips 312 and 322 in the opposite direction, causing them to disengage the post slots 202 and 203, such that locking post 201 is free to be removed from the locking section 300.

A double lock is necessary and superior over a single lock mechanism because a force must be applied to both grip surfaces 311 and 321 simultaneously to release the lock, since both locking tips 312 and 322 have engaged post slots 202 and 203, respectively. Both post slots must be disengaged before locking post 201 can be released from the insertion cavity 301 of the lock section 300. Having two locks prevents an unintended force applied against one of the locking bars 310 or 320 from disengaging the locking post 201.

It will be understood that there are numerous modifications of the illustrated embodiments described above which will be readily apparent to one skilled in the art, including any other combinations of features disclosed herein that are individually disclosed or claimed herein, explicitly including additional combinations of such features. These modifications and/or combinations fall within the art to which this invention relates and are intended to be within the scope of the claims, which follow. It is noted, as is conventional, the use of a singular element in a claim is intended to cover one or more of such an element.

While the foregoing invention has been described in some detail for purposes of clarity and understanding, it will be appreciated by one skilled in the art, from a reading of the disclosure, that various changes in form and detail can be made without departing from the true scope of the invention.

The invention claimed is:

1. A double lock mechanism comprising:

a post section comprising a locking post and a plurality of post slots recessed into the locking post; and a locking section configured to engage the post section, the locking section comprising:

an insertion cavity configured to receive the locking post;

a plurality of locking bars, each locking bar comprising an outwardly facing side and an inwardly facing side, wherein each of the outwardly facing sides comprises a grip surface, and wherein each of the inwardly facing sides comprises a first end having a locking tip configured to engage one of the plurality of post slots, a second end having a spring tip, and an attachment point between the first end and second end at which each of the locking bars are pivotally coupled to the locking section, wherein the attachment point of each of the inwardly facing sides share a common pivoting axis comprising a pin to which the locking bars are attached to each other and about which the locking bars pivot, wherein a distance from each of the locking tips to the attachment points on the respective locking bars are of different lengths such that the locking tips are offset along the locking post from each other, and a spring having two ends, each end attached to each of the spring tips, the spring configured to spread the spring tips away from each other and bias the locking bars in an engaged orientation relative to the post slots, such that the locking tips engage the post slots;

wherein the plurality of locking bars are configured to disengage the post section when an external pressing force is applied to the grip surfaces, causing the spring to compress, causing a first rotational movement of the locking bars around the attachment point, causing a second rotational movement of the locking tips in the opposite direction of the first rotational movement, and causing each of the locking tips to disengage the one of the plurality of post slots.

2. The double lock mechanism of claim 1, wherein the post slots are disposed on opposite sides of the locking post.

3. The double lock mechanism of claim 1, wherein the post slots are offset from each other along an axis of the locking post.

4. The double lock mechanism of claim 1, wherein the grip surfaces have a rough finish.

5. The double lock mechanism of claim 1, wherein the rough finish comprises bumps, grooves, or a similarly textured surface.

6. The double lock mechanism of claim 1, wherein the mechanism further comprises a jewelry body having a first end, a second end, and a hinge between the first end and second end; wherein the post section further comprises a first attachment end and the locking section further comprises a second attachment end; and wherein the first attachment end is attached to the first end of the jewelry body and the second attachment end is attached to the second end of the jewelry body.

7. The double lock mechanism of claim 6, wherein the lock section is partially disposed within the jewelry body such that only the grip surfaces, or a portion thereof, are exposed.

* * * * *